US008801237B2

(12) United States Patent
Pearson et al.

(10) Patent No.: US 8,801,237 B2
(45) Date of Patent: Aug. 12, 2014

(54) MODULAR LED LIGHTING APPARATUS

(75) Inventors: Dennis Pearson, Foothill Ranch, CA (US); Wesley Scott Dochnahl, Upland, CA (US); Guang Jin, Santa Monica, CA (US); Jorge Santana, Irvine, CA (US)

(73) Assignee: Tempo Industries, LLC, Irvine, CA (US)

( * ) Notice: Subject to any disclaimer, the term of this patent is extended or adjusted under 35 U.S.C. 154(b) by 166 days.

(21) Appl. No.: 13/533,802

(22) Filed: Jun. 26, 2012

(65) Prior Publication Data

US 2013/0279179 A1 Oct. 24, 2013

Related U.S. Application Data

(60) Provisional application No. 61/637,132, filed on Apr. 23, 2012.

(51) Int. Cl.
*F21V 21/00* (2006.01)

(52) U.S. Cl.
USPC ..... 362/364; 362/249.02; 362/800; 362/294

(58) Field of Classification Search
CPC ..... F21S 4/008
USPC ..... 362/364, 249.02, 800, 294
See application file for complete search history.

(56) References Cited

U.S. PATENT DOCUMENTS

| | | | |
|---|---|---|---|
| 7,726,840 | B2 | 6/2010 | Pearson et al. |
| 8,002,426 | B2 | 8/2011 | Pearson et al. |
| 8,061,870 | B2 | 11/2011 | Pearson et al. |
| 8,398,276 | B2 | 3/2013 | Pearson et al. |
| 2013/0271979 | A1 | 10/2013 | Pearson et al. |
| 2013/0272000 | A1 | 10/2013 | Pearson et al. |

*Primary Examiner* — Elmito Breval
(74) *Attorney, Agent, or Firm* — Greenberg Traurig LLP; Franklin D. Ubell

(57) ABSTRACT

Modular LED light fixture units are interconnected together in articulated fashion with each modular unit including a base component and a cover component. First and second of the base components each include a cylindrical recess formed at a first end with a vertical boss positioned therein, the vertical boss having a threaded opening therein and an extension member formed at a second, opposite end and positioned within first and second outer fingers. The hole in the extension member of the first base component and the boss of the second base component are so positioned, shaped, and dimensioned that a fastener is insertable through the hole in the extension member of the first base component and into the boss of the second base component to thereby pivotally interconnect the first and second base components.

27 Claims, 12 Drawing Sheets

MODULAR LED LIGHTING APPARATUS

CROSS REFERENCE TO RELATED APPLICATIONS

This application claims the benefit of and priority to U.S. Provisional Application Ser. No. 61/637,132, filed Apr. 23, 2012, entitled "Modular LED Lighting Apparatus," the contents of which is incorporated by reference herein in its entirety.

BACKGROUND

1. Field

The subject disclosure relates to modular LED lighting fixtures providing a series of interconnectable and articulatable LED lighting units or modules.

2. Related Art

Various decorative and/or accent linear lighting apparatus such as rope light, luminous incandescent lighting, and festoon lighting have been in use for some time.

SUMMARY

Lighting apparatus according to an illustrative embodiment may comprise two or more individual LED modular light fixture units interconnected together in articulated fashion with each modular unit including a base component and a cover component. In one embodiment, a first base component of a first unit has a cylindrical recess formed at a first end thereof with a vertical boss positioned therein, the vertical boss having a threaded opening therein. A flat horizontally positioned extension member having a hole therein is formed at a second, opposite end of the first base component and is positioned within first and second outer fingers.

The illustrative embodiment further employs a second base component of a second modular unit, which also has a cylindrical recess formed at a first end thereof and a vertical boss positioned within the cylindrical recess, the vertical boss having a threaded opening therein. A horizontally positioned extension member having a hole therein is formed at a second, opposite end of the second base component and also is positioned within first and second outer fingers.

According to the illustrative embodiment, the hole in the extension member of the first base component and the vertical boss of the second base component are so positioned, shaped, and dimensioned that a screw or other fastener is insertable through the hole in the extension member of the first base component and into the vertical boss of the second base component to thereby pivotally interconnect the first and second base components. First and second cover components, each having a receptacle therein for an LED carrying circuit board, are respectively shaped and dimensioned to fit onto and threadably attach to a respective one of the first and second base components.

DETAILED DESCRIPTION

Figure 1:
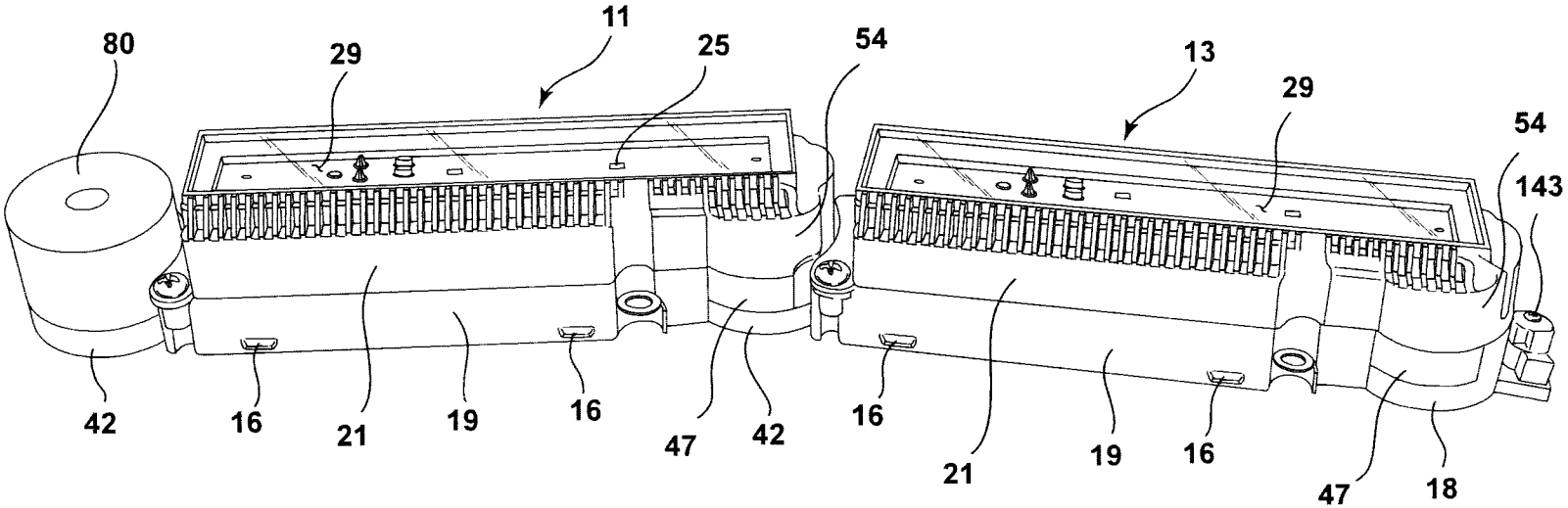
FIG. 1 is a perspective view of two illustrative modular lighting units interconnected according to an illustrative embodiment.

FIG. 1 is a perspective view of lighting apparatus according to an illustrative embodiment. FIG. 1 illustrates a pair of individual LED modular light fixture units 11, 13 interconnected together in articulated fashion. A conduit feed clamp 18 is pivotally mounted at an end of one unit 13 in order to receive and retain an electrical conduit feed.

As further shown in FIGS. 1-6, each modular unit 11, 13 includes a base 19 and a cover 21. In one embodiment, the base and cover 19, 21 of each modular unit 11, 13 may be identically shaped and fabricated of a metal having suitable thermal or heat sinking characteristics, such as, for example, the zinc alloy ZAMAK 3. Other materials may be used in other embodiments. Horizontally extending tabs, e.g., 16 may be formed along the bottom edges of each base unit 19 in one embodiment.

Figure 2:
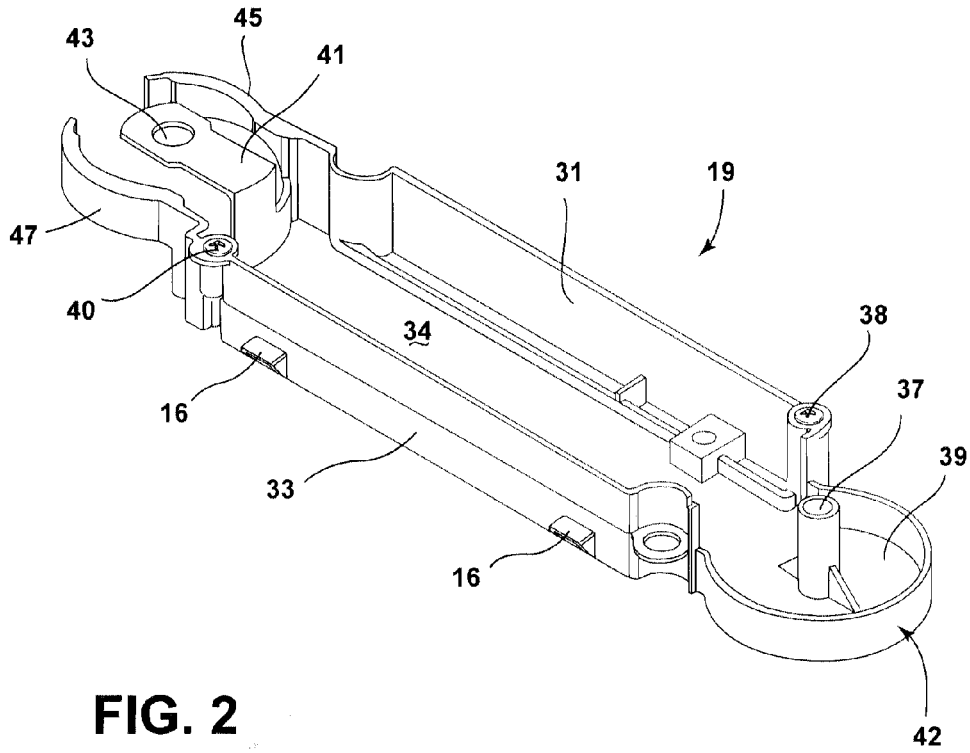
FIG. 2 is a perspective view of a base component of a modular lighting unit or fixture according to an illustrative embodiment.
Figure 3:
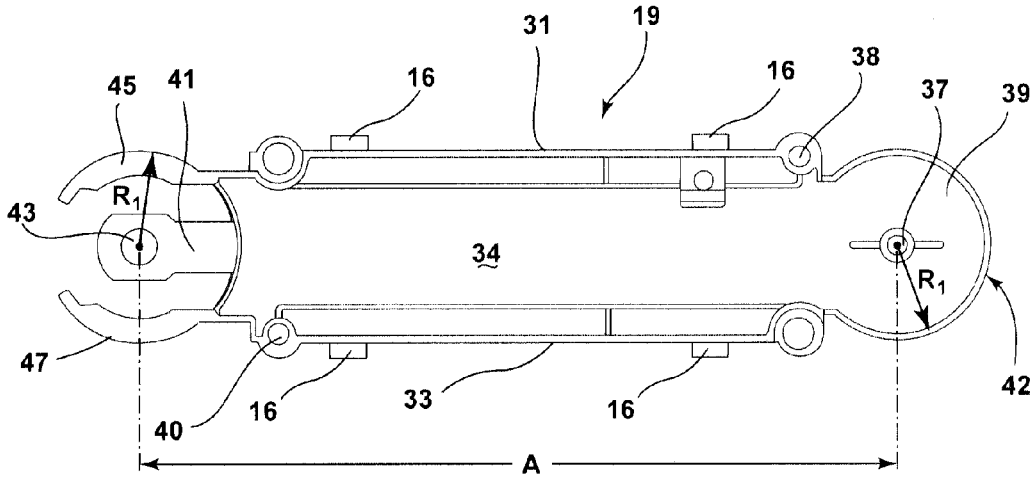
FIG. 3 is a top view of the base component of FIG. 2.

As seen in FIG. 2, the base 19 has flat rectangular sides 31, 33 and a generally flat bottom surface 34 formed at right angles with the sides 31, 33. A cylindrical vertical male plug or boss 37 with a cylindrical threaded opening is concentrically positioned within a semi-cylindrical recess 39 defined by a semi-cylindrical outer wall 42 at one end of the base 19, while a horizontally positioned extension member 41 having a cylindrical hole 43 at one end thereof is formed at the opposite end of the base 19. The extension member 41 is positioned within two arcuate outer fingers 45, 47, which, in one embodiment, have a common inner radius and share a common center with the hole 43 in the extension member 41. In one embodiment, respective outer radii $R_1$ of the outer fingers 45, 47 and recess 39 are the same, for example, 0.750 inches such that the outer surfaces of mating units, e.g., 11, 13, meet flushly with one another.

In one embodiment, adjacent modules 11, 13 may be connected together by inserting a screw through hole 43 of one module into the threaded opening of the male boss 37 of an adjacent module. In one embodiment, the depth of insertion of the screw is controlled such that a pivotal interconnection results such that units such as 11, 13 may pivot, e.g., up to ninety degrees or more with respect to one another.

Figure 4:
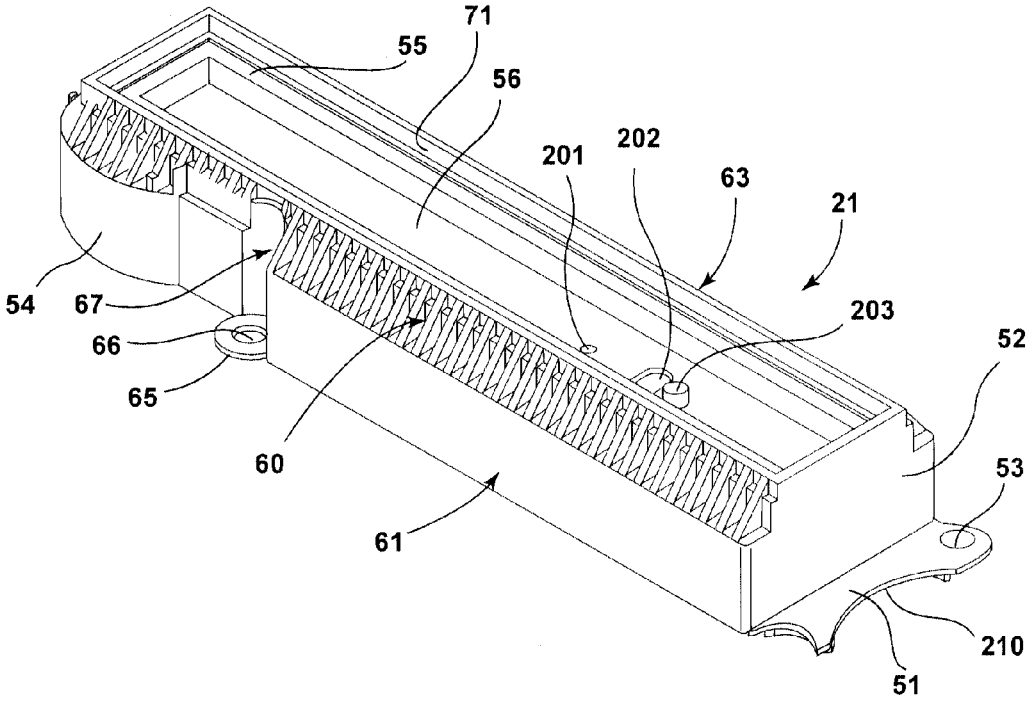
FIG. 4 is a perspective view of a cover component of a modular lighting unit or fixture according to an illustrative embodiment.
Figure 5:
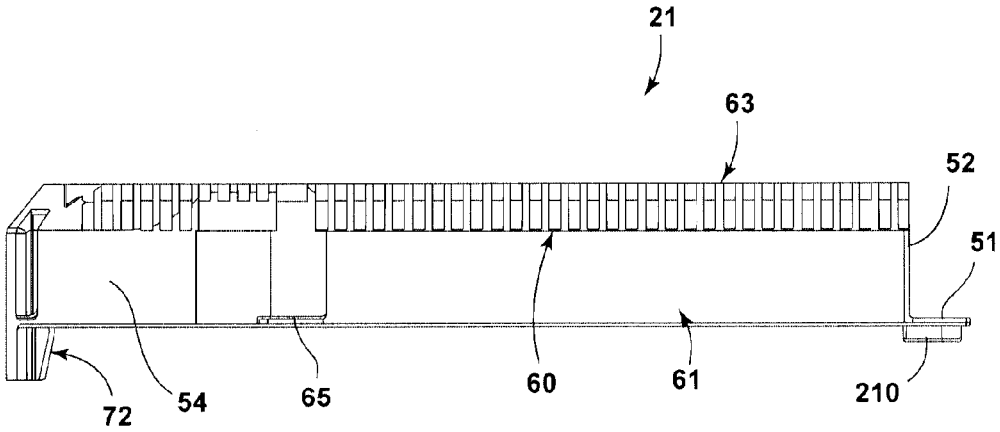
FIG. 5 is a side view of the cover component of FIG. 4.
Figure 6:
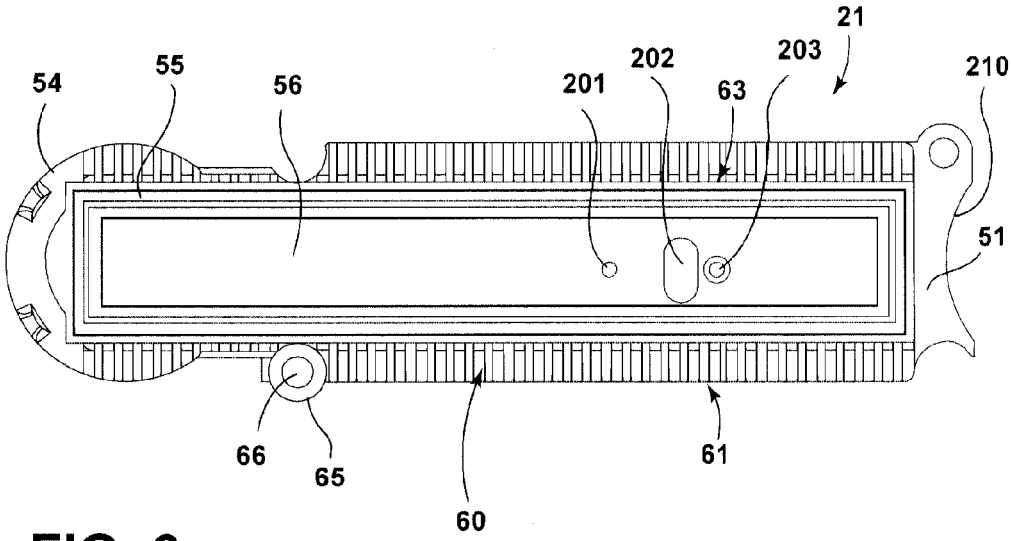
FIG. 6 is a top view of the cover component of FIG. 4.

The illustrative cover member or cover component 21 of FIG. 4 has respective flat side surfaces 61, 63. A tab 65 having a hole 66 therein is formed in a semi-cylindrical recessed area 67 of the cover 21. A second tab 51 having a hole 53 therein is formed along the bottom edge of the back surface 52 of the cover member 21. In one embodiment, screws are inserted through the holes 53, 66 and into threaded bosses 38 and 40 of the base member 19 to attach the cover 21 to the base 19. The cover member 21 further has a semi-cylindrical cap 54 formed at a front end thereof, which, in one embodiment, is sized to mate flushly with the arcuate sides of the respective fingers 45, 47 of the base 19 to close the unit.

As seen particularly in FIG. 4, the cover member 21 has a rectangular edge or lip 55 formed in its interior to provide a ledge upon which a lens 29 (FIG. 1) rests and an adjacent vertical wall 71, which further serves to position the lens 29. The circuit board 27 rests on the floor 56 of the cover member 21, and in one embodiment is attached using thermal tape to facilitate heat transfer. In other embodiments, a topical coating such as grease or paste that aids in heat dissipation may be employed. Angled heat sink fins 60 are provided on both sides of the cover 21 for thermal management/heat dissipation. The floor 56 of the cover 21 includes a hole 201 to receive a pin holder mounting screw 212 (FIG. 13), an opening 202 through which conductive pins 217, 219 (FIG. 14) extend, and a cylindrical post 203, which fits through a hole in the PCB 27 (FIG. 14) and serves to align the PCB 27. An arcuate surface 210 is shaped to mate with the nose end 54 of an adjacent unit and to permit relative pivotal movement between the respective surfaces of those components 210, 54.

Figure 7:
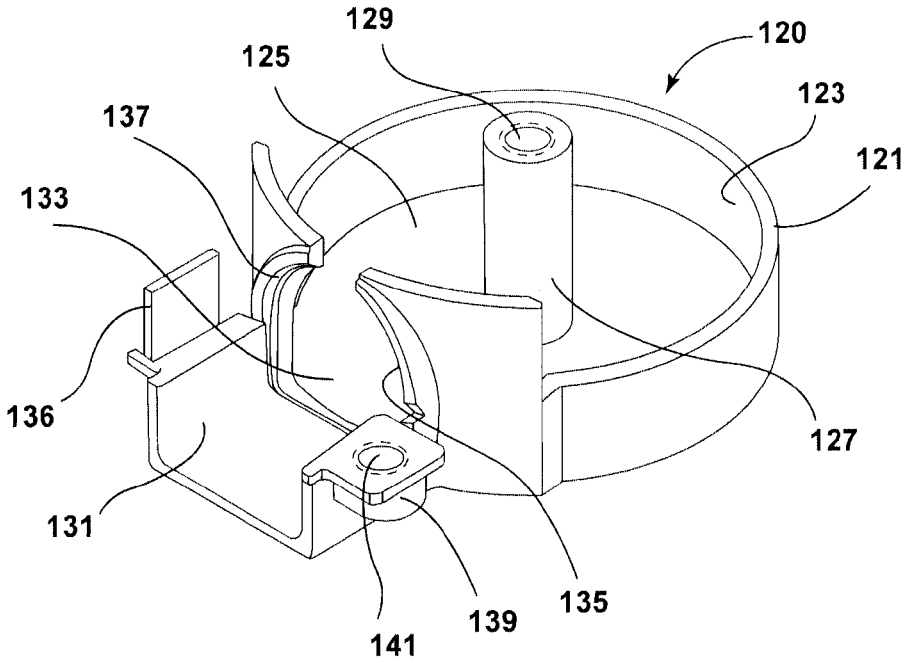
FIG. 7 is a perspective view of a bottom half of an illustrative embodiment of a conduit feed clamp.
Figure 8:
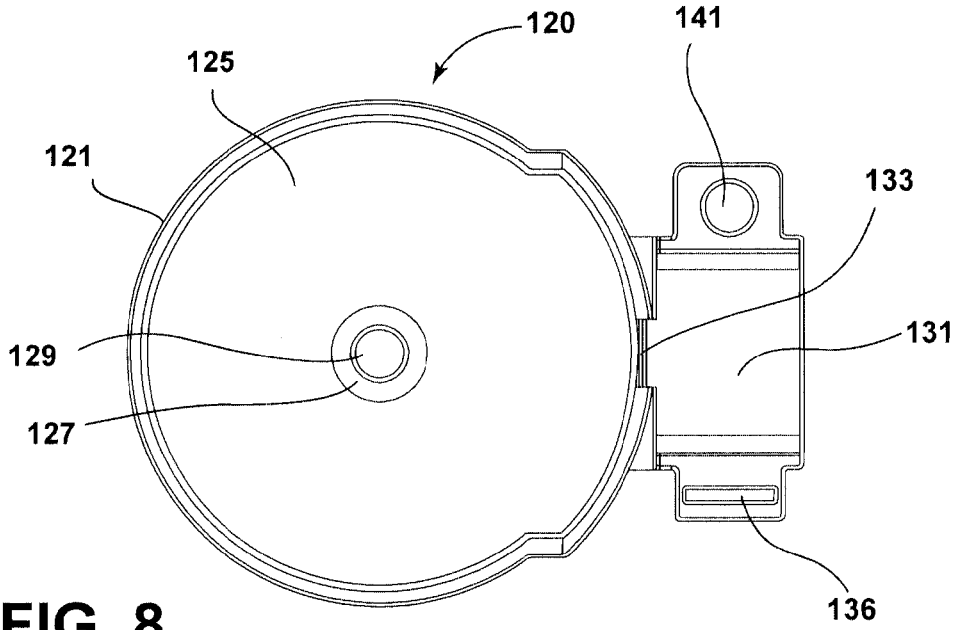
FIG. 8 is a top view of the conduit feed clamp of FIG. 7.

FIGS. 7 and 8 illustrate the bottom half 120 of the electrical conduit feed clamp 18 shown in FIG. 1, which may be fabricated of ZAMAK 3 in one embodiment. The clamp 18 includes a circular rear portion 121 with a an inner circular vertical wall 123 surrounding a flat floor 125. A cylindrical vertical boss 127 with a threaded cylindrical interior 129, tapped through in one embodiment, is centrally positioned on the floor 125. In the illustrative embodiment, the wall 123 is concentrically positioned with the boss 127 and the interior threaded portion 129.

The bottom half 120 further includes a front entry way 131 of generally rectangular cross-section and a cable receiving opening 133. The cable receiving opening 133 is flanked on either side by respective arcuate walls 135, 137. A vertically disposed rectangular tab 136 is formed at one side of the entry way 131, and a boss 139 with a threaded opening 141 is formed on the opposite side.

A cover for the rear circular portion 121 of the conduit feed clamp 18 is formed by the respective fingers 45, 47 of the base unit 19 and the semi-cylindrical cap 54. In one embodiment, the side surfaces of the rear circular portion 121, the fingers 45, 47 and the cap 54 mate flushly with one another. In one embodiment, a depending portion 72 at the front end of the cover member 21 serves to partially close the lead-passing opening or entry way 133 of the clamp 18.

Figure 9:
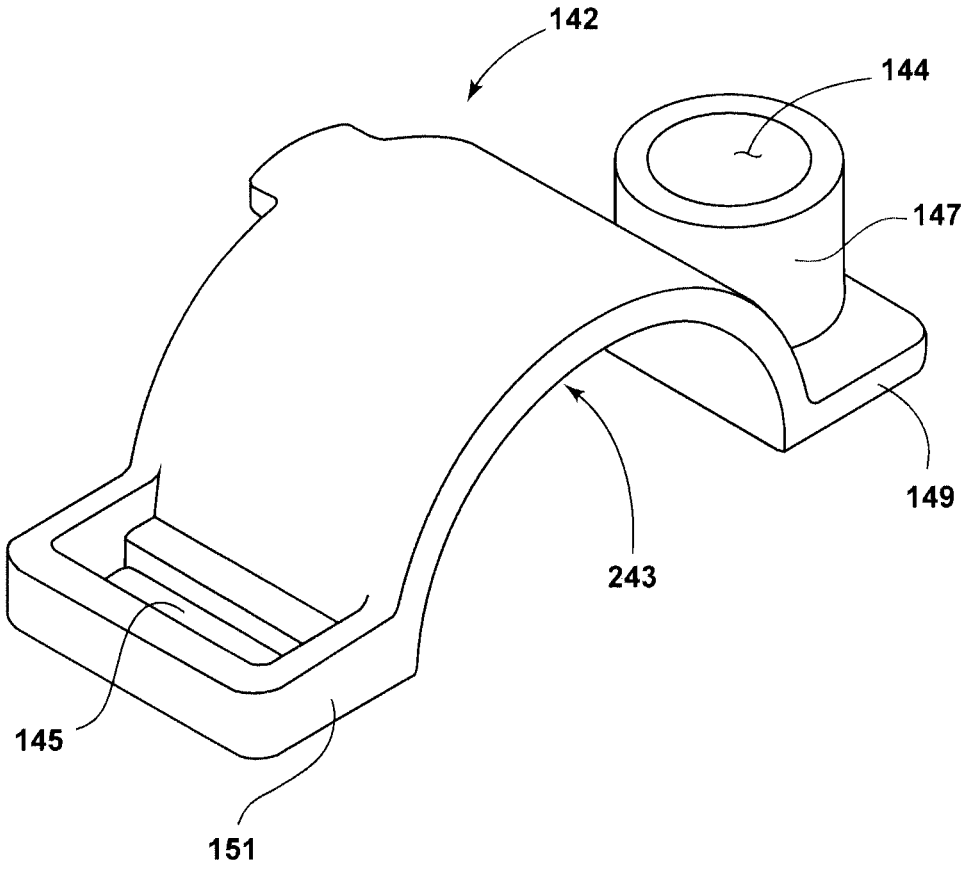
FIG. 9 is a perspective view of a top half of a conduit feed clamp according to an illustrative embodiment.

The top front half 142 of the conduit feed clamp 18 is illustrated in FIG. 9. The top half 142 includes a top or cover portion 243 of semicircular cross-section with an integrally formed slot 145 and vertically projecting cylinder 147 formed on respective horizontally projecting side surfaces 149, 151 thereof. As may be appreciated, the slot 145 is positioned, shaped and dimensioned to mate with the tab 136 of the bottom half 120 of the conduit feed clamp 18, while the cylinder 147 is positioned, shaped and dimensioned to reside concentrically over the threaded hole 141 such that a threaded fastening device such as a screw 143 (FIG. 1) may be used to fasten the top and bottom halves 120, 142 of the clamp 18 together.

Figure 10:
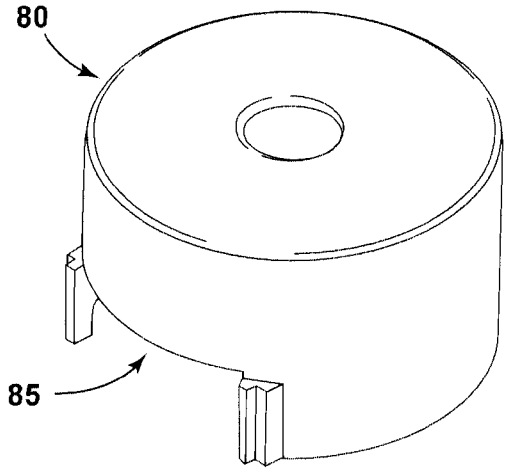
FIG. 10 is a perspective view of an end cover component according to an illustrative embodiment.
Figure 11:
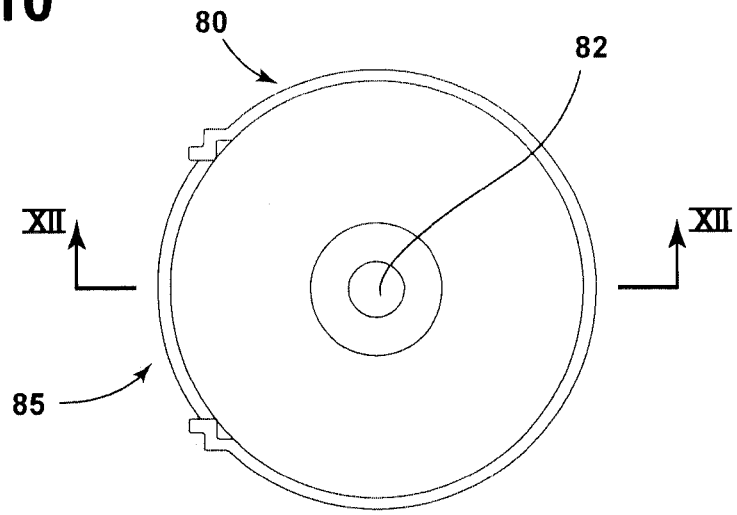
FIG. 11 is a top view of the cover component of FIG. 10.
Figure 12:
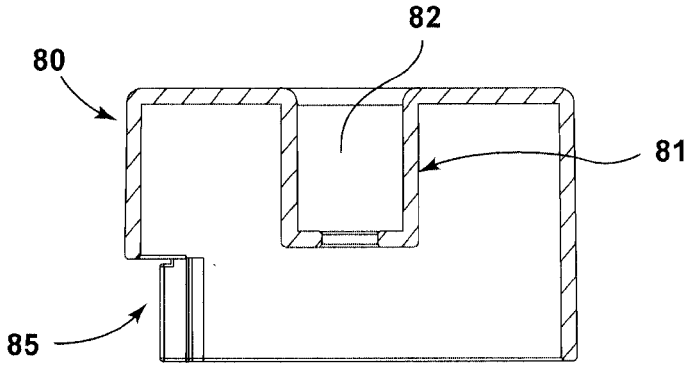
FIG. 12 is a sectional view taken at XII-XII of FIG. 11.

FIGS. 10 and 11 illustrate an end cover component 80, which includes a central sunken boss 81 having a hole 82 therein. The end cover component 80 is cylindrical and of the same diameter as the outer wall 42 of a base unit 19 such that its outside surface contour flushly mates with the outside surface contour of the outer wall 42 of the base unit 19. A passageway 85 is provided in the end cover 80 to permit passage of electrical leads.

Figure 13:
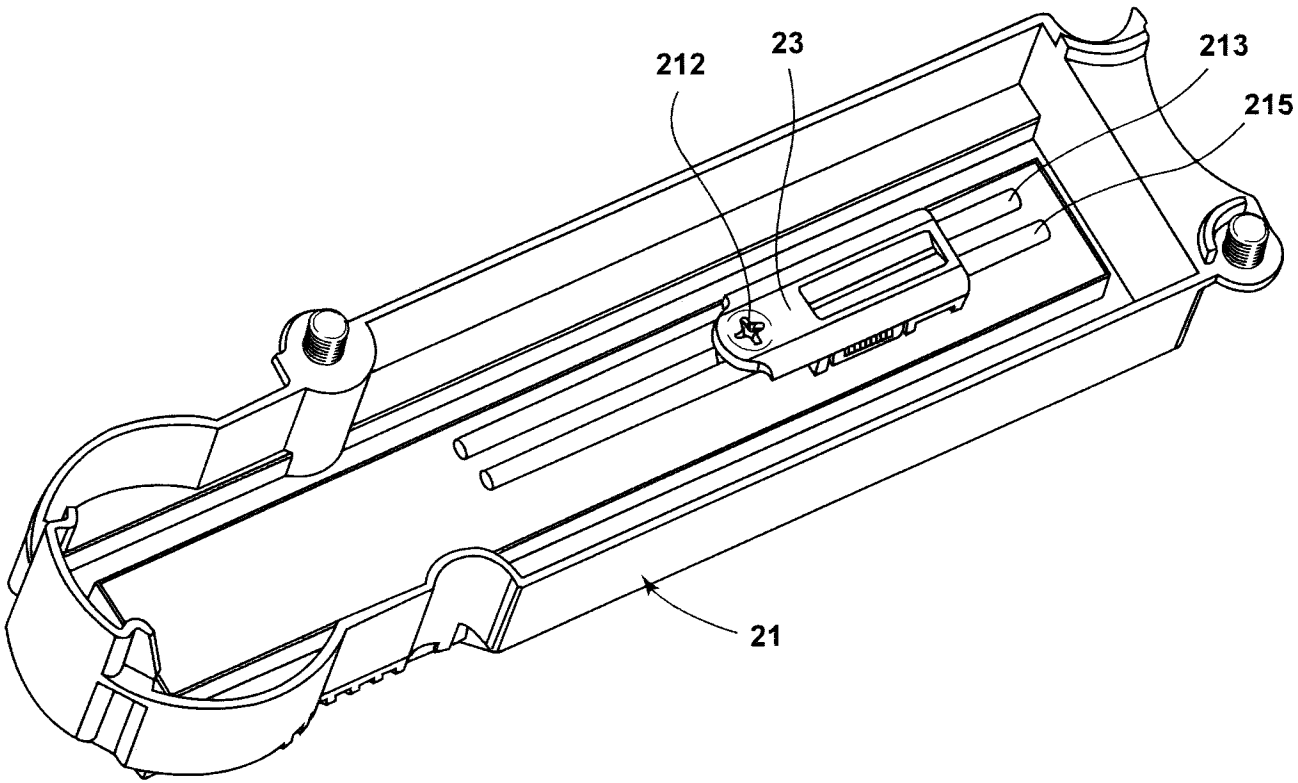
FIG. 13 is a perspective view of the underside of an illustrative cover component with a pin holder component in place.
Figure 14:
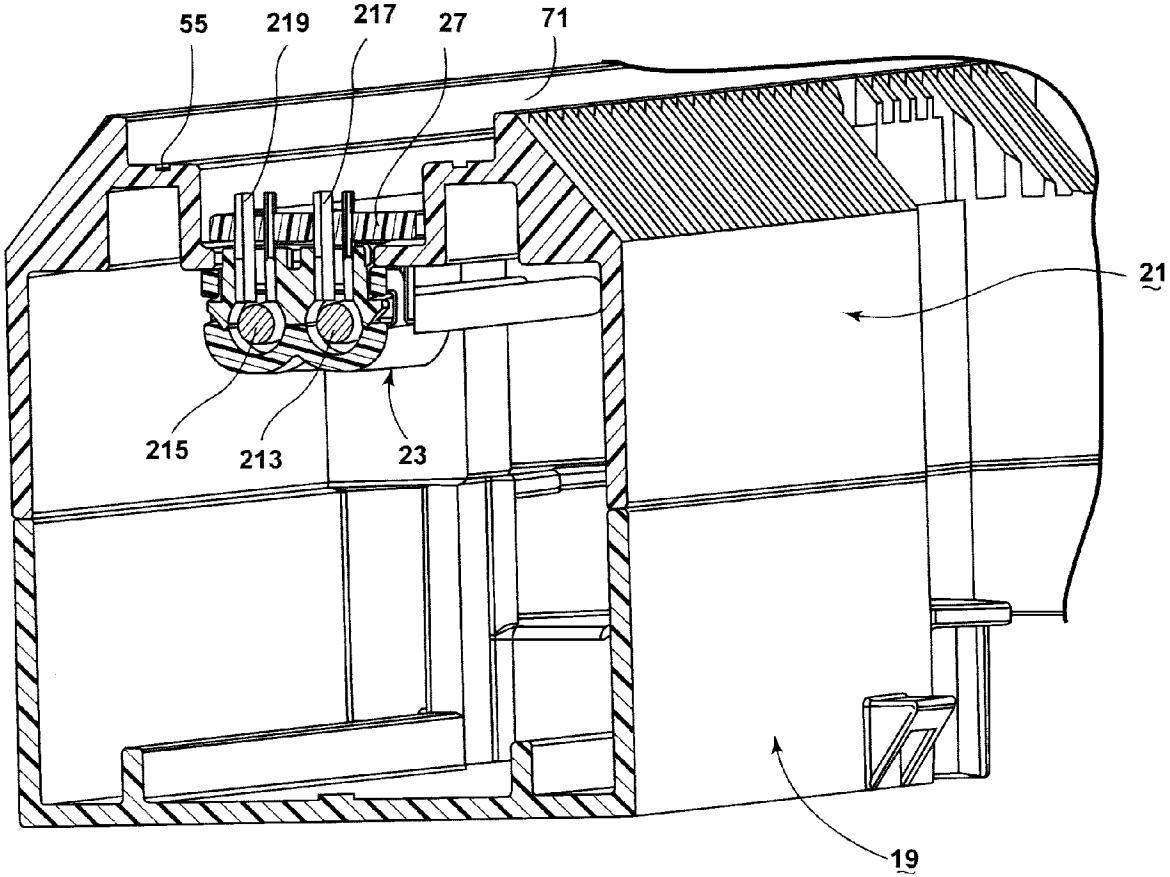
FIG. 14 is a perspective cutaway view of the cover component further illustrating the pin holder, pins and conductors in place.

A pin holder 23 is attached to the underside of the cover member 21 by a screw 212 as shown in FIGS. 13 and 14. The pin holder 23 receives electrical leads 213, 215 and holds two electrically conductive power pins 217, 219 in position to supply power to one or more LEDs, e.g., 25 mounted on a circuit board 27. The circuit board 27 is supported by the cover member 21, which further may receive and mount a colored gel or acrylic lens 29 to change the color of the light output from the modular unit, if desired, and to protect the underlying printed circuit board 27.

Figure 15:
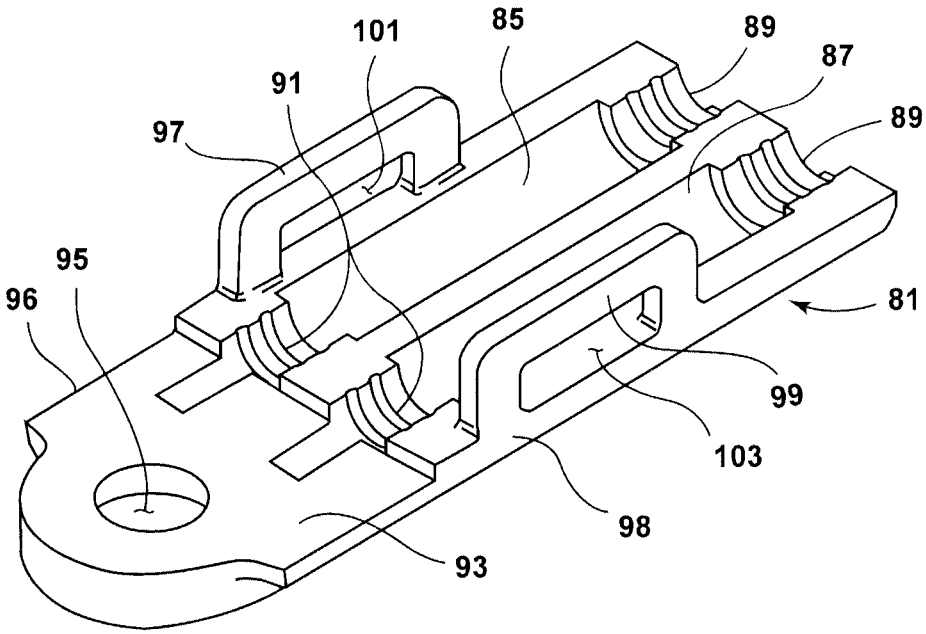
FIG. 15 is a perspective view of a bottom half of the pin holder component of FIGS. 13 and 14.
Figure 16:
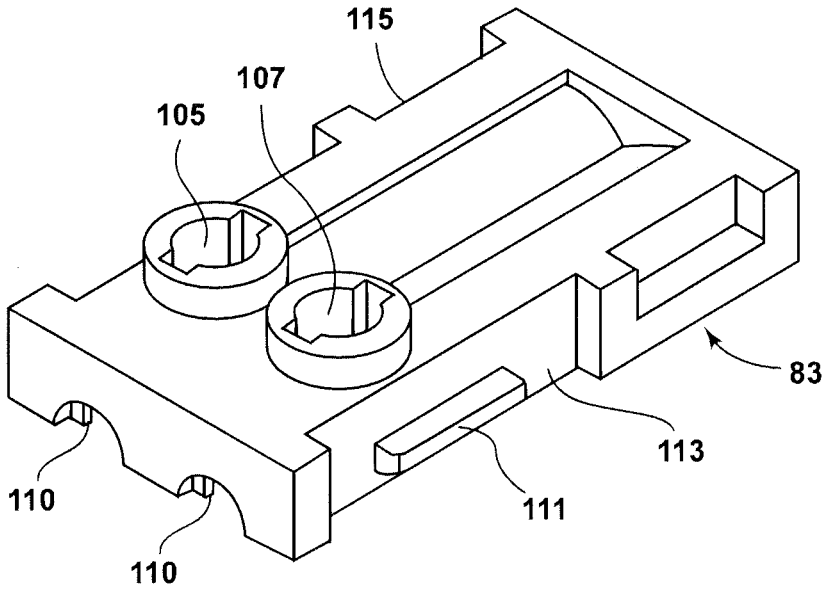
FIG. 16 is a perspective view of the top half of the pin holder.

FIGS. 15 and 16 respectively illustrate the bottom half 81 and top half 83 of the pin holder 23, which may be fabricated, for example, of a plastic such as nylon. The bottom half 81 includes central wire channels 85,87 of semicircular cross-section located between respective entry ways 89 and exit ways 91. The bottom half 81 further includes a tab 93 formed at the front thereof, which includes a mounting hole 95. Respective vertically standing side rails 97, 99 with respective rectangular openings 101, 103 are formed on opposite sides 96, 98 of the bottom half 81.

The top half 83 of the pin holder 23 show in FIG. 16 includes pin exit openings 105, 107, respective wire way entry openings (not shown) and exit openings 110. Semicircular channels similar to the channels 85, 87 are formed in the interior of the top half 83, such that respective electrical conductors 213, 215 can be clamped within the pin holder 23 when the top half 83 and bottom half 81 are mated together.

Respective tabs, e.g., 111 are formed on respective sides 113, 115 of the top half 81 and are positioned, shaped and dimensioned to snap-fittingly engage the respective rectangular openings 101, 103 of the side rails 97, 99 of the bottom half 81 to thereby join the two components 81, 83 together after electrical conductors 213, 215 and pins 217, 219 have been appropriately placed in the bottom half 81.

FIG. 13 shows the pin holder 23 mounted to the underside of the cover component 21 by a screw 212. Electrical leads 213, 215 enter the pin holder 23 and supply two upright or vertical electrically conductive pins 217, 219 seen in FIG. 14. These pins 217, 219, extend through holes 105, 107 in the pin holder 23, through the opening 202 in the floor of the cover member 21 and then through the respective holes in the PCB 27 to supply power to the components mounted on the printed circuit board 27.

Figure 17:
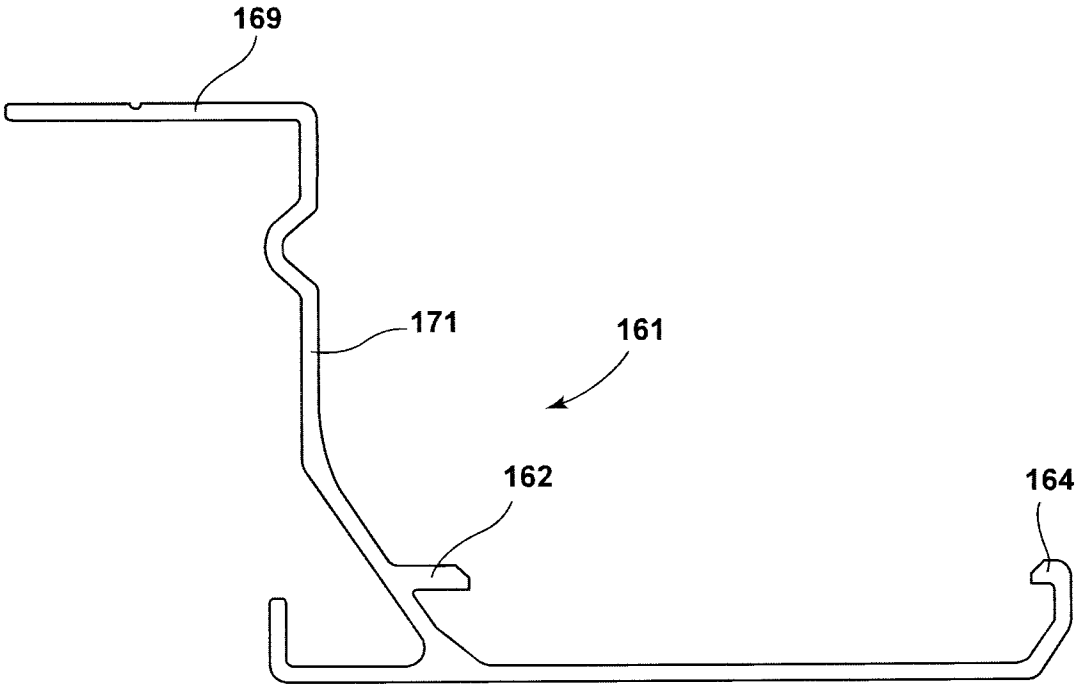
FIG. 17 is a side view of a guide track useful for mounting various embodiments.
Figure 18:
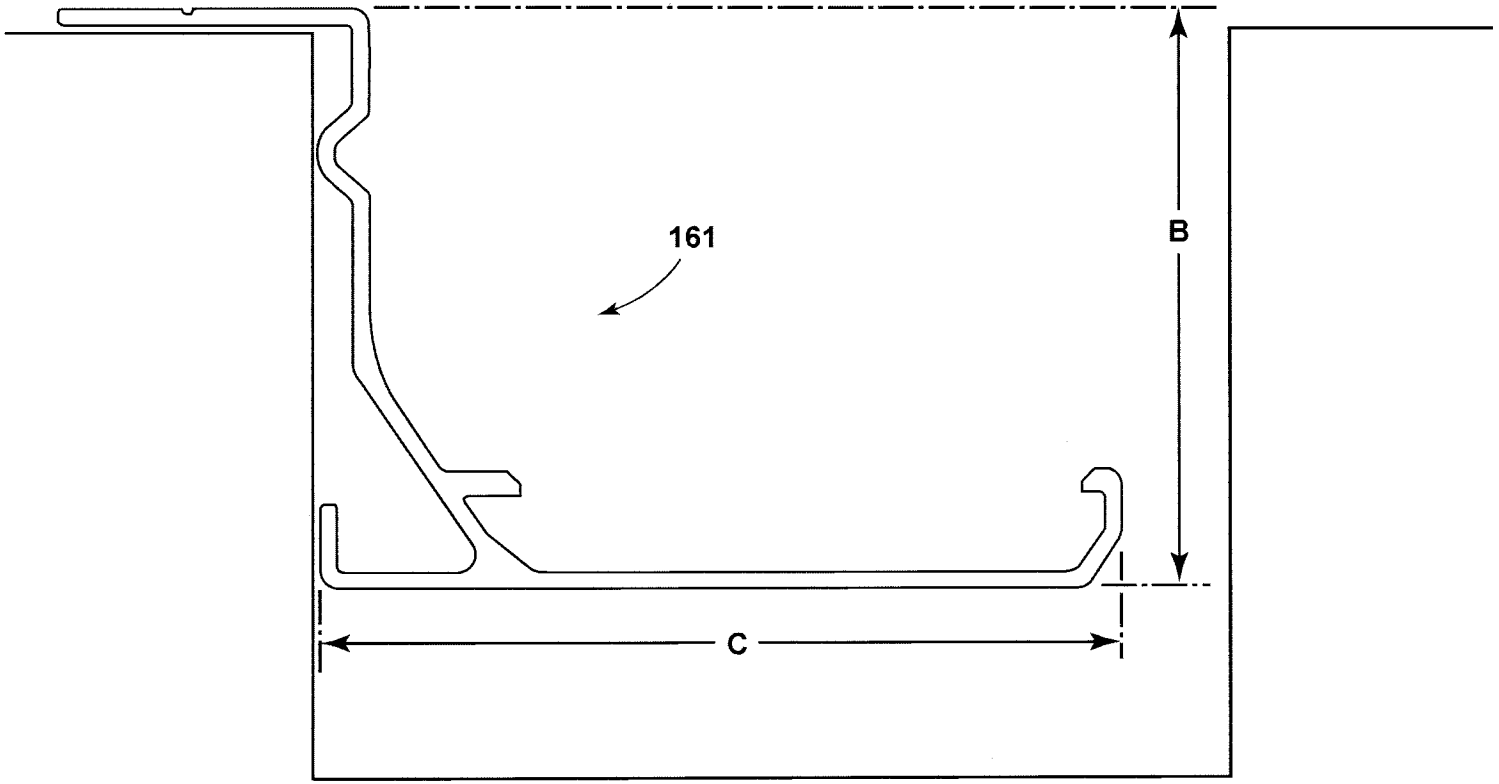
FIG. 18 is a side view of a guide track according to FIG. 17 installed in a cove recess.

FIGS. 17 and 18 illustrate a useful zero degree mounting track or soffit 161, which may be used to mount the modular units, e.g., 11. As may be seen, the mounting track 161 includes respective side fingers 162, 164 which are positioned to engage side tabs 16 on respective sides of the base unit 19, to allow the base unit 19 to snap-in or otherwise be held in place. The mounting track 161 may be attached by screws suitably inserted through its top or side surfaces 169, 171. In one embodiment shown in FIG. 18, the track 161 mounts to a top outside lip 168 of a cove 170 when the cove space is too deep so as to elevate a modular unit 11, 13 to achieve an optimal lighting effect.

Various embodiments of the lighting apparatus just described above may provide a reduced size, fully integral, articulated LED lighting system designed to fit into confined spaces and deliver over 140 lumens per foot, featuring highly efficient lighting class LEDs. Various embodiments may provide continuous runs of high quality light in various color temperatures. Illustrative embodiments have the ability to bend at 90 degree angles with no shadows or hot spots.

One embodiment may accept a 120 volt power supply with an integral transformer/driver, simplifying design, installation and maintenance with run lengths up 120 feet. Various embodiments may be dimmable with ELV type dimmers. Illustrative light output may be provided by three 80 mA LED chips per 6" section producing 90+ lumens per foot, or enhanced light output provided by three 150 mA chips per 6" section producing 140+ lumens per foot. Such embodiments are energy efficient, drawing only 1.7 or 3.3. watts per foot with a life expectancy >50,000+ hours. The six inch modules of one embodiment allow for more flexibility, fitting into different length runs. Clear cast acrylic lenses, diffuser lenses, or colored lenses may be employed. In one embodiment, dimension "A" in FIG. 3 may be, for example, 6.0 inches, while dimensions "B" and "C" of FIG. 18 may be 1.66 inches and 2.335 inches respectively. Other dimensioning of course may be used in other embodiments.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. The LED light fixture apparatus comprising:

a first base component having a cylindrical recess formed at a first end thereof and a vertical boss positioned within the cylindrical recess, the vertical boss configured to pivotally interconnect with a fastening device;

the first base component further having an extension member formed at a second, opposite end thereof and positioned within first and second outer fingers, the extension member having a hole therein;

a second base component further having a cylindrical recess formed at a first end thereof and a vertical boss positioned within the cylindrical recess, the vertical boss configured to pivotally interconnect with a fastening device;

the second base component further having an extension member formed at a second, opposite end thereof and positioned within first and second outer fingers, the extension member having a hole therein;

the hole of the extension member of the first base component and the vertical boss of the second base component being so positioned, shaped, and dimensioned that a screw or other fastening device is insertable through the hole of the extension member of the first base component so as to pivotally interconnect with the vertical boss positioned within the cylindrical recess of the second base component to thereby pivotally interconnect the first and second base components; and first and second cover components, each having a receptacle therein for an LED carrying circuit board, each of the first and second cover components being shaped and dimensioned to fit onto and attach to a respective one of said first and second base components.

2. The apparatus of claim 1 wherein said first and second base components and said first and second cover components comprise respective modules, each module including a rectangular LED circuit board flanked on respective sides by angled heat sink fins and each module comprising respective semi-cylindrical mating front end portions.

3. The LED light fixture apparatus of claim 2 further comprising a zero degree mounting track comprising respective side fingers which are positioned to engage side tabs on respective sides of one of said first and second base components to hold the said one of said first and second base components in place.

4. The LED light fixture apparatus of claim 3 wherein the mounting track mounts to a top outside lip of a cove.

5. The LED light fixture apparatus of claim 2 wherein a cover component has a concave arcuate rim shaped to mate with a nose end of an adjacent base component to permit relative pivotal movement between the respective surfaces of the respective cover and base components.

6. The LED light fixture apparatus of claim 1 wherein said first and second cover components each removably attach to a respective one of said first and second base components.

7. The LED light fixture apparatus of claim 1 wherein respective centers of the cylindrical recess and the first and second fingers of the first base component are 6 inches apart.

8. The LED light fixture apparatus comprising:

a first base component having a cylindrical recess formed at a first end thereof and a vertical boss centrally positioned within the cylindrical recess, the cylindrical recess being encompassed by a first vertical outer side wall of semi-cylindrical contour of a first radius, the vertical boss configured to pivotally interconnect with a fastening device;

the first base component further having a first horizontally disposed extension member formed at a second, opposite end thereof and positioned within first and second outer fingers, the first extension member having a first hole therein, the first and second outer fingers each having an arcuate vertical outer wall of a common outer radius, said common outer radius being equal to the first radius of said first vertical outer side wall, the horizontally disposed extension member having a hole therein;

a second base component having a cylindrical recess formed at a first end thereof and a vertical boss positioned within the cylindrical recess, the cylindrical recess being encompassed by a second vertical outer side wall of semi-cylindrical contour of a second radius, the vertical boss configured to pivotally interconnect with a fastening device;

the second base component further having a second horizontally disposed extension member formed at a second, opposite end thereof and positioned within first and second outer fingers, the second extension member having a second hole therein, the first and second outer fingers each having an arcuate vertical outer wall of a common outer radius, said common outer radius being equal to the second radius of said vertical outer side wall, the horizontally disposed extension member having a hole therein;

the first hole of the first horizontally disposed extension member of the first base component and the vertical boss of the second base component being so positioned, shaped, and dimensioned that a screw or other fastening device is insertable through the first hole of the first extension member of the first base component so as to pivotally interconnect with the vertical boss within the cylindrical recess of the second base component, thereby pivotally interconnecting the first and second base components and such that the first vertical outer side wall encompassing the cylindrical recess of the first base component aligns flushly with the arcuate vertical outer walls of the first and second outer fingers of the second base component; and first and second cover components, each having a receptacle therein for an LED carrying circuit board, each of the first and second cover components being shaped and dimensioned to fit onto and attach to a respective one of said first and second base components.

9. The LED light fixture apparatus of claim 8 wherein said first cover component comprises a cap at one end thereof having a semi-cylindrical vertical side wall shaped and dimensioned to align and mate flushly with the respective arcuate vertical outer walls of the first and second outer fingers of said first base component.

10. The LED light fixture apparatus of claim 8 further comprising:

an electrical conduit feed clamp having a circular rear portion comprising an inner circular vertical wall surrounding a flat floor; and a cylindrical vertical boss having a threaded cylindrical interior and centrally positioned on the flat floor.

11. The LED light fixture apparatus of claim 10 wherein the electrical conduit feed clamp further comprises a front entry way and a cable receiving opening, the cable receiving opening being flanked on either side by respective walls.

12. The LED light fixture apparatus of claim 11 further comprising a vertically disposed rectangular tab formed at one side of the entry way and a boss with a threaded opening formed on the opposite side of the entry way.

13. The LED light fixture apparatus of claim 12 wherein a depending portion at the front end of one of said first and second cover components serves to partially close the entry way.

14. The LED light fixture apparatus of claim 13 wherein the conduit feed clamp further comprises a top half having a top or cover portion of semicircular cross-section with an integrally formed slot and a vertically projecting cylinder formed on respective horizontally projecting side surfaces thereof, the slot being positioned, shaped and dimensioned to mate with the tab of the bottom half of the conduit feed clamp while the cylinder is positioned, shaped and dimensioned to reside concentrically over the threaded hole so as to enable a fastening device to fasten the top and bottom halves of the conduit feed clamp together.

15. The LED light fixture apparatus of claim 8 further comprising an end cover component having a central sunken boss with a hole therein, the end cover component being cylindrical and of the same diameter as the outer wall of a base component such that the outside surface contour of the end cover component flushly mates with the outside surface contour of the first vertical outer side wall of the first base component.

16. The LED light fixture apparatus of claim 15 wherein said end cover component further comprises a passageway provided therein and configured to permit passage of electrical leads.

17. The apparatus of claim 8 further comprising a pin holder attached to the underside of one of said first and second cover components.

18. The LED light fixture apparatus of claim 17 wherein the pin holder receives electrical leads and holds two electrically conductive power pins in position to supply power to one or more LEDs mounted on a circuit board.

19. The LED light fixture apparatus of claim 18 wherein the pin holder further comprises a bottom half, the bottom half including a plurality of central wire channels of semicircular cross-section located between respective entry ways and exit ways, the bottom half further including a tab formed at a front thereof, the tab including a mounting hole and the bottom half further including respective vertically standing side rails with respective openings located on opposite sides of the bottom half.

20. The apparatus of claim 19 wherein the pin holder further comprises a top half, the top half including a plurality of pin exit openings on a top surface thereof and respective wire way entry openings and wireway exit openings, the top half further including semicircular channels formed in an interior thereof and configured such that respective electrical conductors can be clamped within the pin holder when the top and bottom halves are mated together.

21. The LED light fixture apparatus of claim 20 wherein respective tabs are formed on respective sides of the top half of the pin holder and are positioned, shaped and dimensioned to snap-fittingly engage the respective rectangular openings of the side rails of the bottom half of the pin holder to thereby join the top and bottom halves together after respective electrical conductors and respective pins have been positioned in the bottom half.

22. The LED light fixture apparatus of claim 21 wherein the pin holder is mounted such that the respective electrical leads enter the pin holder and supply two upright electrically conductive pins, which pins extend through holes in the pin holder through an opening in a floor of the cover component and then through respective holes in a printed circuit board to thereby supply power to the one or more LEDs mounted on the circuit board.

23. The LED light fixture apparatus of claim 8 wherein respective centers of the cylindrical recess and the first and second fingers of the first base component are 6 inches apart.

24. The LED light fixture apparatus of claim 8 wherein the first and second base components and the first and second cover components are formed of Zamak 3 material and wherein each cover component further comprises a plurality of heat sink fins formed on opposite sides thereof.

25. The LED light fixture apparatus of claim 8 wherein said first and second cover components each removably attach to a respective one of said first and second base components.

26. The LED light fixture apparatus of claim 8 wherein said first radius and said second radius are the same.

27. The LED light fixture apparatus comprising:

a first base component having a cylindrical recess formed at a first end thereof and a vertical boss centrally positioned within the cylindrical recess, the cylindrical recess being encompassed by a vertical outer side wall of semi-cylindrical contour of a first radius, the vertical boss configured to receive a fastening device; and the first base component further having a horizontally disposed extension member formed at a second, opposite end thereof and positioned within first and second outer fingers, the outer first and second fingers each having an arcuate vertical outer wall of a common outer radius, said common outer radius being equal to the first radius of said vertical outer side wall, the horizontally disposed extension member having a hole therein.

* * * * *